US010420423B2

(12) United States Patent
Schmidt et al.

(10) Patent No.: US 10,420,423 B2
(45) Date of Patent: Sep. 24, 2019

(54) ITEM OF SEATING FURNITURE, IN PARTICULAR AN OFFICE CHAIR

(71) Applicant: Armin Sander, Fuerth (DE)

(72) Inventors: Christopher Schmidt, Nuremberg (DE); Mark Grant Jones, Lancashire (GB)

(73) Assignee: Armin Sander, Fuerth (DE)

( * ) Notice: Subject to any disclaimer, the term of this patent is extended or adjusted under 35 U.S.C. 154(b) by 0 days.

(21) Appl. No.: 15/883,508

(22) Filed: Jan. 30, 2018

(65) Prior Publication Data

US 2018/0213939 A1 Aug. 2, 2018

(30) Foreign Application Priority Data

Jan. 30, 2017 (DE) ..... 20 2017 100 480 U

(51) Int. Cl.

| | |
|---|---|
| ***A47C 1/032*** | (2006.01) |
| ***A47C 7/44*** | (2006.01) |
| ***A47C 3/12*** | (2006.01) |
| *A47C 3/18* | (2006.01) |
| *A47C 3/20* | (2006.01) |
| *A47C 5/12* | (2006.01) |
| *A47C 7/40* | (2006.01) |
| *A47C 7/54* | (2006.01) |

(52) U.S. Cl.

CPC ..... *A47C 3/12* (2013.01); *A47C 1/03261* (2013.01); *A47C 7/44* (2013.01); *A47C 7/443* (2013.01); *A47C 3/18* (2013.01); *A47C 3/20* (2013.01); *A47C 5/12* (2013.01); *A47C 7/40* (2013.01); *A47C 7/54* (2013.01)

(58) Field of Classification Search

CPC ..... A47C 1/03261; A47C 7/443
USPC ..... 297/383, 354.1
See application file for complete search history.

(56) References Cited

U.S. PATENT DOCUMENTS

| | | | | |
|---|---|---|---|---|
| 148,380 | A * | 3/1874 | Perrenet | A47C 1/032 297/354.1 |
| 2,823,732 | A | 2/1958 | Humphrey | |
| 4,537,445 | A | 8/1985 | Neuhoff | |
| 6,059,363 | A * | 5/2000 | Roslund, Jr. | A47C 1/03255 297/301.4 |
| 6,692,075 | B2 | 2/2004 | Sander et al. | |
| 6,880,886 | B2 | 4/2005 | Bodnar et al. | |

(Continued)

FOREIGN PATENT DOCUMENTS

| | | |
|---|---|---|
| DE | 4235435 A1 | 4/1994 |
| DE | 10122946 C1 | 1/2003 |

(Continued)

*Primary Examiner* — Timothy J Brindley
(74) *Attorney, Agent, or Firm* — Laurence A. Greenberg; Werner H. Stemer; Ralph E. Locher

(57) ABSTRACT

An item of seating furniture, in particular an office chair, has a seat carrier for a horizontal seat member, and a backrest carrier for a vertical backrest. The backrest carrier is constructed in a substantially U-shaped manner with two vertically orientated U-shaped members and with a horizontal upper U-shaped member. Wherein, along at least one rotation axis which extends below the seat member, a first rotary joint and a second rotary joint are provided for the lateral tilting movability of the backrest with respect to the seat carrier. The first and second rotary joints are arranged spaced apart from each other along the rotation axis.

13 Claims, 9 Drawing Sheets

(56) References Cited

U.S. PATENT DOCUMENTS

| | | | | |
|---|---|---|---|---|
| 7,637,570 | B2 * | 12/2009 | Becker | A47C 7/28 297/314 |
| 9,167,902 | B1 | 10/2015 | Chen | |
| 9,504,325 | B2 | 11/2016 | Sander et al. | |
| 2012/0256458 | A1 * | 10/2012 | Gehner | A47C 7/14 297/314 |
| 2014/0300164 | A1 | 10/2014 | Oda | |
| 2015/0245713 | A1 | 9/2015 | Desanta | |

FOREIGN PATENT DOCUMENTS

| | | | |
|---|---|---|---|
| DE | 102007002284 | A1 | 7/2008 |
| DE | 202012012606 | A1 | 6/2013 |
| DE | 102012107778 | A1 | 6/2014 |
| DE | 102011104972 | B4 | 3/2015 |
| WO | 9848670 | A1 | 11/1998 |

* cited by examiner

ITEM OF SEATING FURNITURE, IN PARTICULAR AN OFFICE CHAIR

BACKGROUND OF THE INVENTION

Field of the Invention

The invention relates to an item of seating furniture, in particular an office chair, having a seat carrier for a horizontal seat member and having a backrest carrier for a vertical backrest.

An office chair enables a user seated on the chair to influence the dynamics of the sitting action in a significant manner. In contrast to a rigid chair which enables only a static or movement-free sitting action, with an office chair, as a result of the integrated mechanics and adaptation possibilities, a so-called dynamic sitting is promoted. The dynamic or moving sitting brings about in particular a variable loading of the back muscles, whereby tensions, fatigue and back complaints as a result of longer periods of sitting can be reduced or completely prevented.

DE 101 22 946 C1 discloses an office chair with a movable seat member and with a movable backrest, wherein the seat member and the backrest are coupled by means of a so-called synchronous mechanism. The synchronous mechanism enables a synchronous movement of the seat member or the seat face and the backrest with respect to each other when the backrest is inclined backward from a substantially vertical upright position (starting position) as a result of an action of force by the user. The pivot or tilting movement thereby possible is generally limited in such synchronous mechanisms to a forward and backward inclination (rocking mechanism).

The office chair known from WO 98/48670 A1 has in addition to the synchronous mechanism for a forward and backward inclination a tilting mechanism for a lateral, that is to say, side tilting movement of the backrest. To this end, a substantially horizontally extending carrier arm of the backrest carrier of the backrest is guided into a resiliently loaded rotary bearing of the seat carrier so that the horizontal carrier arm of the backrest carrier forms the rotation axis which extends below the seat face or the seat member.

From DE 10 2007 002 284 A1 it is known to carry out a lateral pivot movement of the backrest of the chair by means of two ball joints which are connected in pairs by means of carrier arms and which are arranged in the lower region of the backrest and in the front region of the seat member.

DE 10 2011 104 972 B4 describes an office chair in which the lateral tilting movement can be carried out by means of two carrier arms of the backrest carrier which are laterally resilient and/or articulated.

BRIEF SUMMARY OF THE INVENTION

An object of the invention is to provide a particularly suitable item of seating furniture, in particular an office chair. In particular the highest possible level of seating comfort and simple adaptation to different seating positions are intended to be enabled.

The object is achieved according to the invention by the features of the independent claim. The dependent claims relate to advantageous embodiments and developments.

The item of seating furniture which is constructed in particular as an office chair has a seat carrier for a horizontal seat member and a backrest carrier for a vertical backrest. The in particular frame-like backrest carrier is substantially U-shaped, wherein two vertical U-shaped members (vertical members) are connected or coupled by means of a horizontal upper U-shaped member.

The backrest of the item of seating furniture can be moved in a tilting manner laterally or to the side or sideways. With respect to a body axis of a user, this tilting movement is consequently carried out in a front plane, that is to say, from a vertical starting position in the direction transversely relative to a forward and backward inclination which is preferably also provided in a sagittal plane of the user.

For this purpose, along at least one rotation axis which extends below the seat member, a first rotary joint and a second rotary joint are provided for the lateral tilting movability of the backrest with respect to the seat carrier. The first and second rotary joints are in this instance arranged spaced apart from each other along the rotation axis. In contrast to the prior art, an additional rotary joint is consequently provided under the seat member along the rotation axis, wherein the rotary joints which are spaced apart from each other are in each case preferably not resiliently loaded.

In a structurally simple manner, a particularly simple adaptation with particular respect to laterally tilted seating positions is thereby produced, whereby an improved dynamic sitting is enabled. This consequently advantageously results in increased seating comfort so that a particularly suitable item of seating furniture is produced, with particular regard to longer periods of sitting.

With respect to a Cartesian coordinate system in which the horizontal seat member or the seat face thereof is located in the xy plane and the backrest extends in the z direction, the vertical U-shaped members of the backrest carrier are orientated substantially parallel with the z direction. The vertical U-shaped members extend substantially from the seat carrier which is located below the seat member in an upward direction. The horizontal U-shaped member is in this instance appropriately arranged approximately in the central or upper region of the backrest and preferably at the rear side thereof. Such a U-shape of the backrest carrier is also intended to be understood to include substantially V-shaped or trapezoidal embodiments in which the vertical U-shaped members are not orientated completely parallel with each other, but instead extend at least partially so as to be inclined at an angle with respect to each other.

In an appropriate embodiment, in order to retain or secure the backrest carrier on the seat carrier, there is provision for the vertical U-shaped members to have at the seat-side free ends thereof retention arms which are orientated horizontally and which extend below the seat member and which at least partially laterally engage around the seat carrier, that is to say, they laterally flank the seat carrier at least partially. As a result of the retention arms which are also referred to below as extension arms, securing arms or carrier arms, the backrest carrier has in a projection onto an xz plane or sagittal plane of a user a substantially L-shaped contour. The vertical L-shaped member is in this instance formed by the vertical U-shaped members and the horizontal L-shaped member is formed by the retention arms.

The backrest carrier which is formed by the retention arms and U-shaped members is in one possible embodiment preferably produced in an integral manner or in one piece, that is to say, monolithically, from a resiliently deformable material, for example, a plastics material or a spring steel material. The backrest carrier, in particular the U-shaped members thereof, preferably have in this instance a cross-sectional shape which enables and/or supports a resilient deformation or torsion along the respective U-shaped member. In the event of a lateral inclination or tilting movement of the backrest, there is consequently also produced an at least slight torsional movement of the backrest about a torsion axis which is orientated parallel with the vertical U-shaped members. As a result of the resilience, there is consequently produced a restoring force which urges the backrest back into the vertical starting position. Consequently, a particularly advantageous and ergonomic sitting, in particular with regard to lateral tilting movements, is ensured.

In a similarly possible embodiment, the backrest carrier is additionally or alternatively to the resilient deformability coupled with resilient elements which produce or support a restoring force during a lateral tilting movement. It is thereby ensured that the backrest is always reliably guided into the starting or upright position.

However, it is also conceivable, for example, for flexible or articulated connection elements to be provided between the vertical U-shaped members and the retention arms and/or between the vertical U-shaped members and the horizontal U-shaped member. It is thereby possible for the U-shaped members and/or the retention arms to be constructed in a (flexibly) rigid manner without influencing the tilting movability of the backrest in an unfavorable manner.

In an advantageous development, there is arranged between the vertical U-shaped members, in particular between the retention arms thereof, a rocker arm which is directed transversely relative to the rotation axis. As a result of the rocker arm which is in the form of a transverse strut and which is arranged in a horizontal manner, the stability of the backrest carrier is improved. Preferably, the rocker arm is in this instance positioned and connected movably or in an articulated manner between the retention arms.

In a possible embodiment, the rocker arm is formed from two half-shells which are stacked vertically one above the other. The assembly of the rocker arm on the backrest carrier is thereby simplified.

For the purposes of the most simple and stable assembly possible, the half-shells of the rocker arm are screwed to each other in a possible embodiment. In an optically particularly attractive development, there is provision in this instance for the screwing of the half-shells to be concealed or covered by means of a positioned covering shell or a covering plate.

In an advantageous configuration, the rocker arm is secured to the seat carrier. To this end, the rocker arm is, for example, secured to a backrest-side end face of the seat carrier using screws. On the one hand, a reliable securing and retention of the backrest carrier to the seat carrier is thereby produced. On the other hand, the movability, in particular the tilting movability, of the backrest as a result of the preferably flexible or articulated connection of the rocker arm to the retention arms of the backrest carrier is not influenced in a disadvantageous manner.

An additional or other aspect of the invention makes provision, along the retention arms, for a first rotary joint and a second rotary joint to be provided for the lateral tilting movability of the backrest with respect to the seat carrier. Preferably, as a result of the first and second rotary joints of the retention arms, a rotation axis is formed in each case for the lateral tilting movability. A particularly advantageous and reliable adaptation to different sitting positions is thereby enabled.

In an advantageous embodiment, the or each first rotary joint is constructed as a ball joint, wherein in each case a joint-head-like continuation of the seat carrier engages in a joint-socket-like receiving member of the retention arm. Also conceivable is a construction of the ball joints in which the receiving members are formed in the seat carrier and the continuations are formed on the retention arms. The first ball joint is in this instance preferably arranged in the region of the free end of the respective retention arm, that is to say, at the arm end remote from the U-shaped members or the backrest. Particularly dynamic sitting is thereby ensured.

In a preferred development, the or each second rotary joint is constructed as a hinge joint, wherein the retention arms each have a roller-like continuation, which continuations are surrounded in each case by a groove-like receiving member of the rocker arm. It is also conceivable to have kinematic inversion with continuations which are formed on the rocker arm and receiving members of the retention arms.

In a conceivable alternative embodiment, the or each first rotary joint is constructed as a hinge joint and the or each second rotary joint is constructed as a ball joint. Embodiments in which both the first and the second rotary joints are constructed as hinge joints or ball joints are also conceivable.

In a preferred embodiment, suitably actuatable blocking means are provided, for example, in the region of the backrest and/or the seat carrier which enable a user to impede or block or arrest or at least limit the side or lateral tilting movability of the backrest carrier or the backrest as desired.

In an appropriate development, the blocking means is constructed to block the rotational movability of the or each second rotary joint. The second rotary joint is arranged along the rotation axis or along the retention arm preferably closer to the backrest carrier or the backrest than the first rotary joint. The lateral tilting movability is thereby reliably inhibited, at least limited or blocked, in the event of a blockage of the second rotary joint. In this instance, it is possible for both second rotary joints to be blocked in a substantially synchronous manner. In order to block the lateral tilting movability, however, the blocking of only one of the two second rotary joints is sufficient.

In an advantageous embodiment, the blocking means is arranged in the rocker arm. The rocker arm is in this instance in particular constructed as a housing for the mechanism of the blocking means. The second rotary joint is in this instance coupled in a pivotably secure manner with a blocking pin which can be moved at the free-end side into a positive-locking engagement with a resiliently loaded blocking block. The blocking block can in this instance be moved in an appropriate manner when the blocking means is actuated so that the engagement or the positive-locking connection between the blocking pin and the blocking block can be released and produced in a reversible manner. Particularly reliable and operationally safe limitation of the lateral tilting movability of the backrest carrier is thereby produced.

BRIEF DESCRIPTION OF THE SEVERAL VIEWS OF THE DRAWING

Embodiments of the invention are explained in greater detail below with reference to the drawings. In the simplified and schematic drawings.

DESCRIPTION OF THE INVENTION

Figure 1:
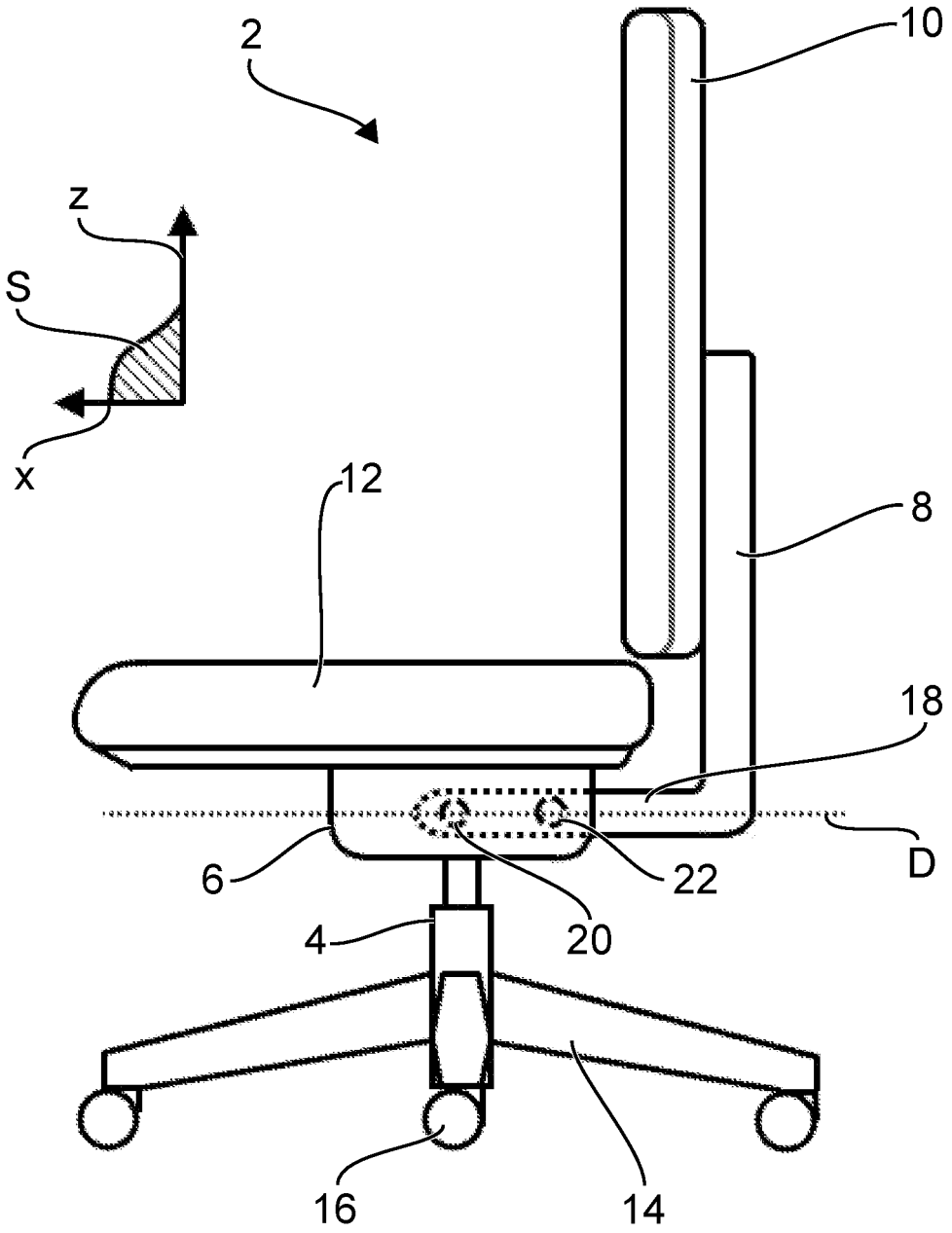
FIG. 1 is a side view of an office chair as an item of seating furniture having a seat carrier for a seat member (seat face) and having a backrest carrier of a backrest which can be inclined in a lateral manner.

Components and extents which correspond to each other are always provided with the same reference numerals in all the Figures.

The seating furniture 2 which is constructed as an office chair in FIG. 1 comprises a seat carrier 6 which is securely connected to a supporting base (cruciform base) 4 and which is coupled by means of a backrest carrier 8 to a backrest 10. There is preferably integrated in the seat carrier 6 a so-called synchronous mechanism which carries out a synchronous movement of a seat member (seat, seat face) 12 which is arranged on the seat carrier 6 with the backrest 10 if it is redirected from the illustrated vertical starting position (upright position) into a position which is inclined toward the rear.

The seat carrier 6 and consequently the seat member 12 and the backrest 10 which is connected to the seat carrier 6 via the backrest carrier 8 are rotatably connected or coupled to the supporting base 4, which has, for example, three, four or five radially extending arms 14 which have chair rollers 16 which are pivotably secured at the end side. For example, only one arm 14 and one chair roller 16 are provided with a reference numeral in the Figures.

FIG. 1 shows the seating furniture or the office chair 2 as a side view when looking toward a sagittal or xz plane S, wherein a corresponding Cartesian coordinate system has an xy plane which is parallel with the seat face of the seat member 12 or transverse plane T and a z axis which is parallel with the starting position of the backrest 10. In this instance, the x axis is orientated substantially along the longitudinal sides of the seat face and the y axis is orientated substantially along the broad sides of the seat face of the seat member 12.

As the side view of FIG. 1 shows in a comparatively clear manner, the backrest carrier 8 has in a projection onto the sagittal plane S substantially an Ls shaped cross-sectional shape. A horizontal retention arm 18 of the backrest carrier 8 directed along the x axis extends in this instance below the seat member 12. In the embodiment of FIG. 1, the retention arm 18 is at least partially received inside the seat carrier 6.

As illustrated in FIG. 1 with dot-dash lines, the retention arm 18 is in this instance constructed and configured by means of two rotary joints 20 and 22 which are spaced apart from each other along the x axis for a lateral tilting movement of the backrest 10, that is to say, an inclination or tilting directed laterally or sideways in a front or yz plane F. Along the connection line between the rotary joints 20 and 22, consequently, a rotation axis D for a lateral tilting movement of the backrest carrier 8 or the backrest 10 is constructed.

In FIGS. 2 to 11, an or the office chair 2 is shown in structurally comparatively detailed illustrations. This embodiment is explained in greater detail below with reference to FIG. 2 to FIG. 11.

Figure 2:
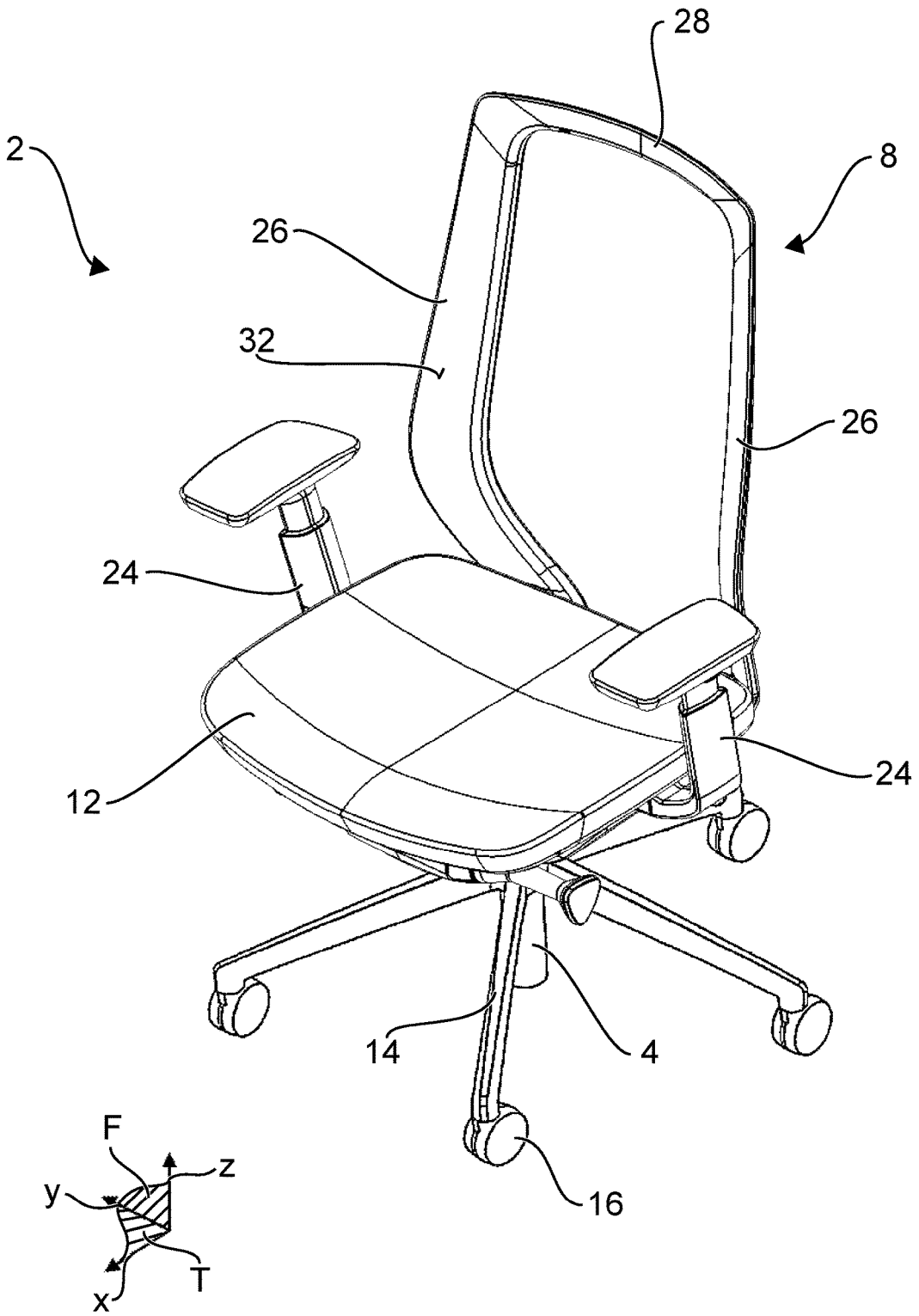
FIG. 2 is a perspective view of the office chair in a second embodiment.

FIG. 2 is a perspective illustration of the office chair 2. There are secured to the seat carrier 6 of the office chair 2 in this embodiment two arm rests 24 which rise up laterally in a vertical direction with respect to the seat member 12. The backrest 10 is not illustrated in FIG. 2 so that a better view of the backrest carrier 8 is enabled. The frame-like backrest carrier 8 is in this embodiment in a projection onto the front plane F substantially U-shaped. The backrest carrier 8 comprises in this instance two vertical U-shaped members (vertical members) 26 which are orientated in the starting position along the z axis and an upper horizontal U-shaped member (horizontal member) 28 which is directed along the Y axis. The members 26, 28 of the backrest carrier 8 form in this instance substantially a securing or carrier frame for the backrest 10 which can be or is fitted thereto.

Figure 3:
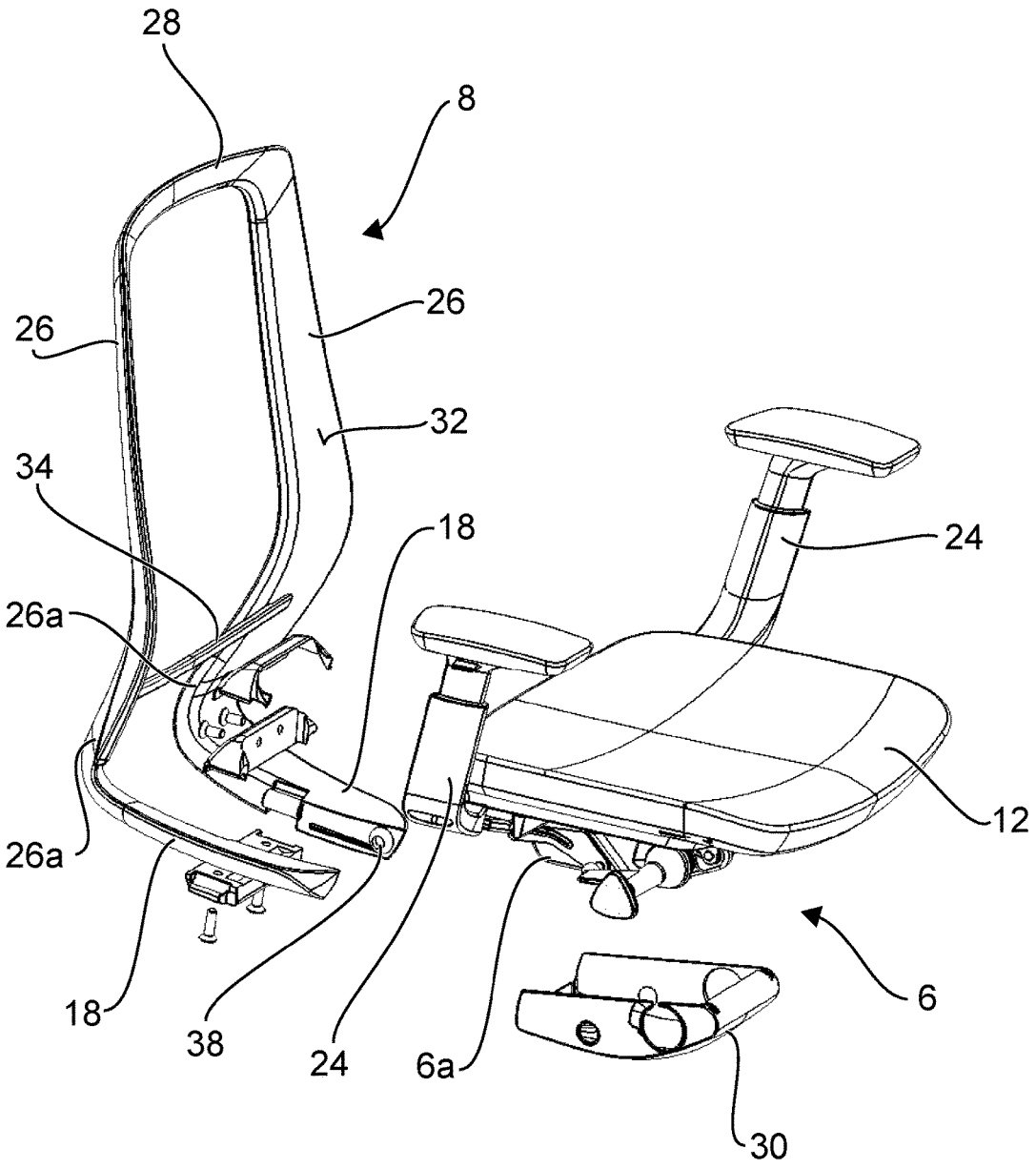
FIG. 3 is an exploded view of the seat carrier and the backrest carrier.

In FIG. 3, the office chair 2 is shown as a perspective exploded illustration or in a partially disassembled state. The seat carrier 6 has a shell-like housing 30 in which in the assembly state a synchronous mechanism 6*a* is received. As can be seen comparatively clearly in the perspective exploded illustration of FIG. 3, two horizontal retention arms 18 are formed at the free ends 26*a* of the vertical members 26, that is to say, at the lower or seat-side member ends.

The retention arms 18 and members 26, 28 form in a one-piece, that is to say, integral or monolithic manner, the backrest carrier 8. The backrest carrier 8 has in this instance an abutment face 32 which is expanded with respect to the backrest 10. As a result of the expanded abutment face 32, the retention arms 18 and members 26, 28 have in cross-section a comparatively small thickness. The backrest carrier 8 is preferably produced from a resilient spring steel or plastics material, wherein the comparatively small material thickness of the retention arms 18 and members 26, 28 enables a high resilient deformability, which is beneficial for the lateral tilting movability of the backrest 10.

As a result of the U-shaped path of the members 26, 28 along the abutment face 32 which is defined by the member width in the direction toward the seat member 12, the backrest 10 which is arranged thereon (not illustrated in greater detail) moves as a result of a sideward or laterally directed force on a circular path or along a circular arc parallel with the front plane F. The radius of this circular-arc-like backrest movement, which can be adapted to the curve contour of the seat member edge which faces the backrest 10 is adjusted, sized or configured in such a manner that the laterally inclined backrest 10 neither enters the seat member 12 in a perceptible manner, nor moves away from it in a perceptible manner.

Figure 5:
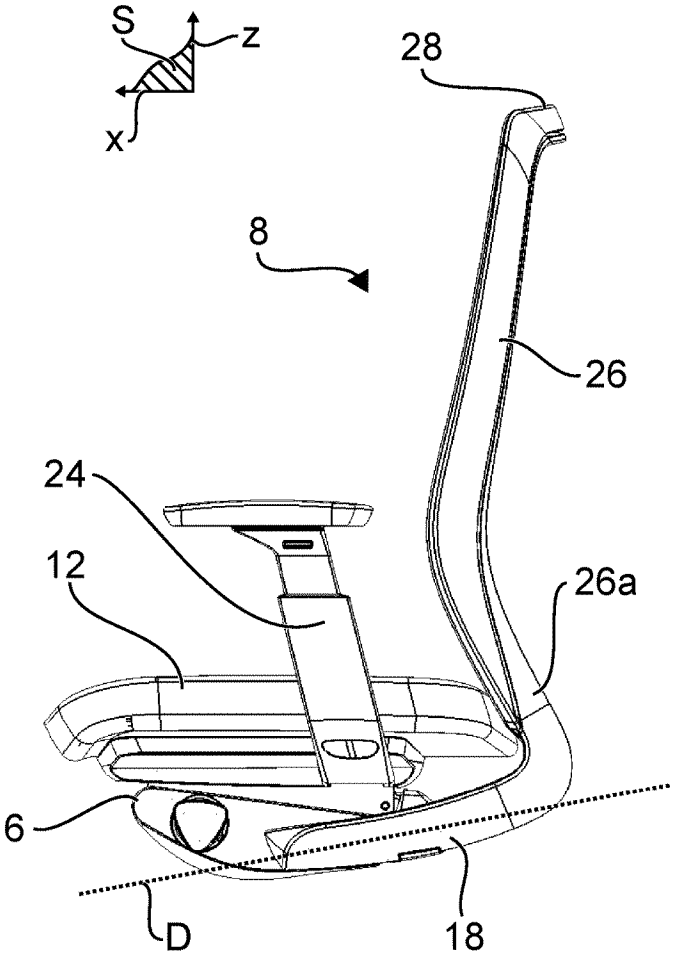
FIG. 5 is a side view of the seat carrier and the backrest carrier.
Figure 4:
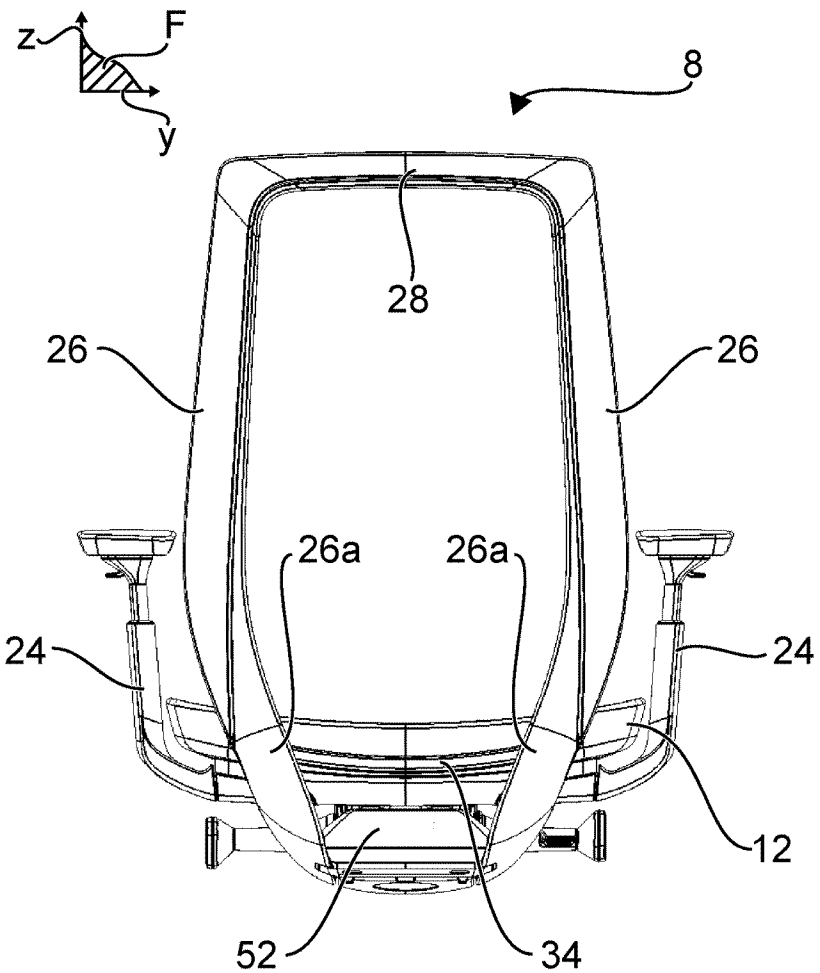
FIG. 4 is a rear view of the seat carrier and the backrest carrier of the office chair.

As can be seen comparatively clearly in FIGS. 4 and 5, the vertical members 26 are in this embodiment slightly inclined in a projection onto the sagittal plane S (FIG. 5), wherein the vertical members 26 in the projection onto the front plane F (FIG. 4) are orientated in particular in the region of the free ends 26*a* so as to taper toward each other in a substantially V-shaped manner. The free ends 26*a* extend in this instance in a manner slightly inclined toward the rear, that is to say, away from the seat member 12, so that the backrest carrier 8 is formed in a substantially S-shaped manner in the projection onto the sagittal plane S.

The upper S-shaped curve is in this instance formed by the horizontal member 24 and the vertical members 26, wherein the lower S-shaped curve is formed by the retention arms 18 and the central region which connects the curves is formed by the free ends 26*a*. The resilience of the backrest carrier 8, including with respect to a forward and backward tilting movement, is thereby improved.

Figure 6:
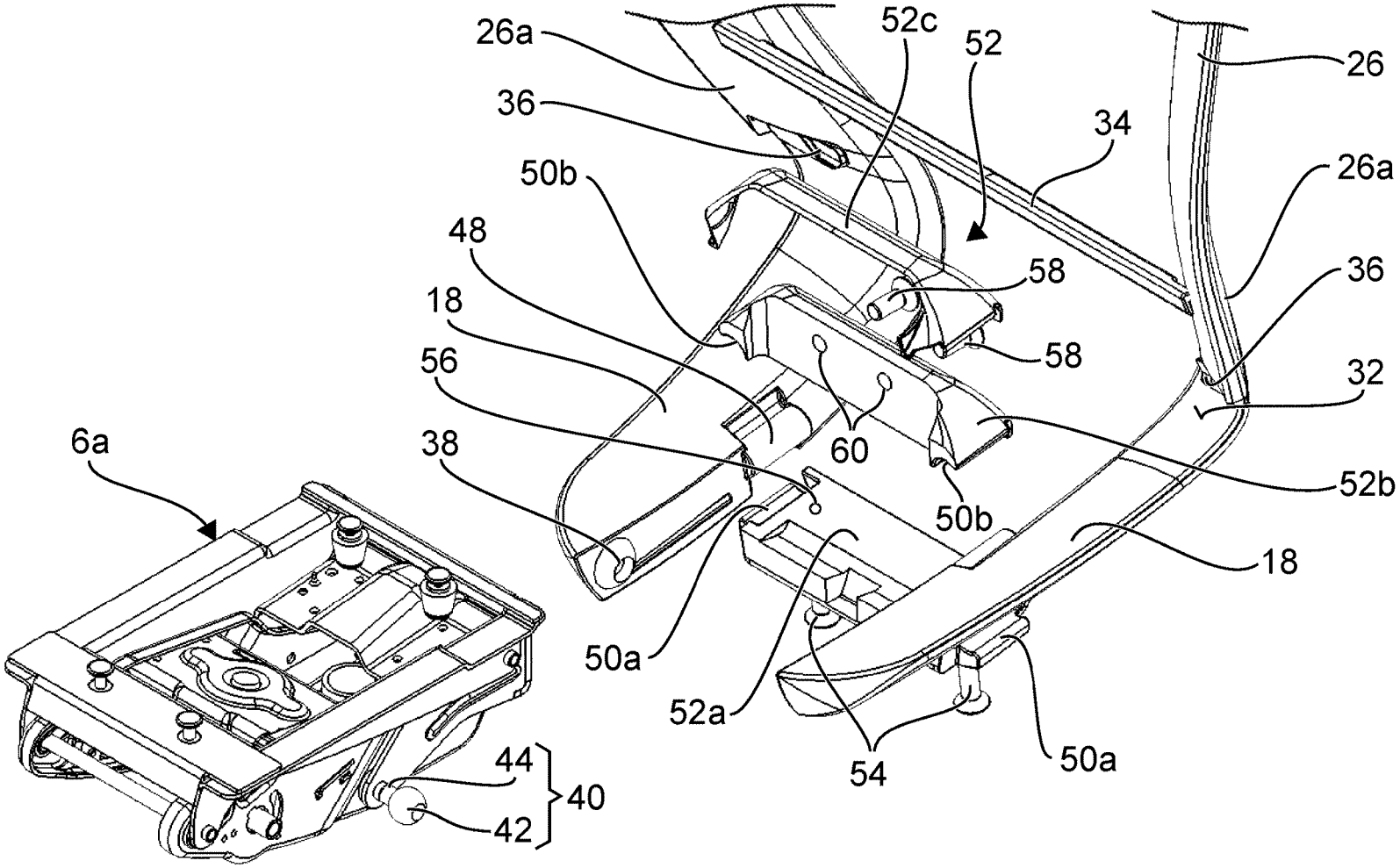
FIG. 6 is a cutout of a perspective exploded view of the seat carrier and the backrest carrier.

With reference to FIG. 6, the lateral tilting movability of the backrest 10 or the backrest carrier 8 is explained in greater detail. FIG. 6 is a cutout of the synchronous mechanism 6*a* of the seat carrier 6 and the lower portion of the backrest carrier 8 in a non-assembled state.

In the region of the lower S-shaped curve, that is to say, in the transition region of the free ends 26*a* to the retention arms 18, in the assembled state a transverse strut 34 is fitted. The transverse strut 34 can be secured in each case at a securing location 36 of the vertical members 26 or the free ends 26*a* thereof so that the transverse strut 34 in the assembly state extends substantially at the height of the seat member 12 horizontally between the vertical members 26 (FIG. 4, FIG. 7).

The transverse strut 34 is preferably produced from a resilient glass fiber material and has with regard to the sagittal plane S, for example, a substantially U-shaped cross-sectional shape. Additionally or alternatively, the securing of the transverse strut 34 at the securing locations 36 is carried out by means of flexible or articulated connection elements. As a result of the transverse strut 34, the stability of the frame-like backrest carrier 8 is improved, wherein at the same time the resilient deformability or torsion of the vertical members 26 is not limited in an unfavorable manner during a lateral tilting or inclination of the backrest 10.

Figure 7:
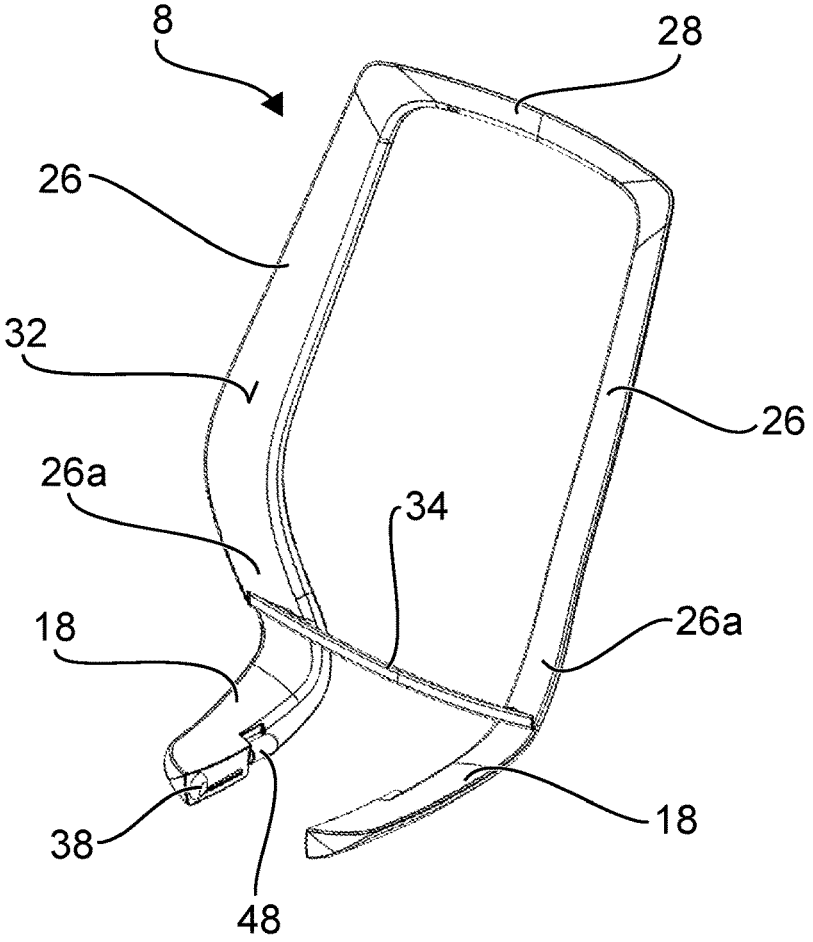
FIG. 7 is a perspective view of the backrest carrier.
Figure 8:
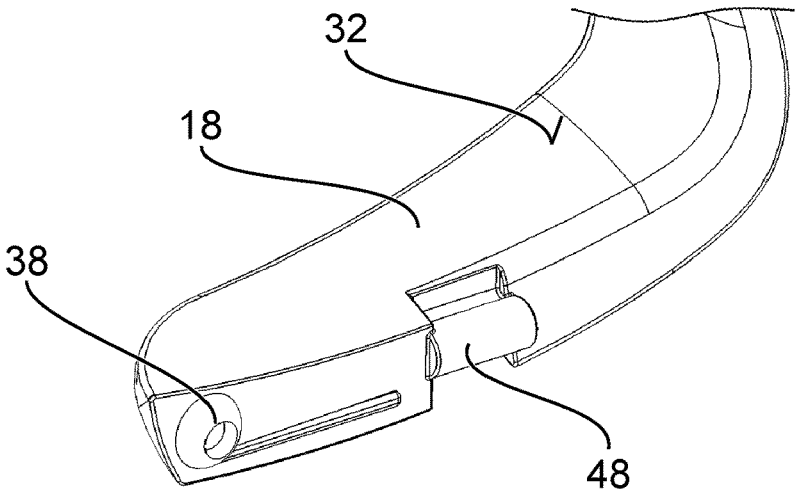
FIG. 8 is a cutout of a perspective view of a retention arm of the backrest carrier.

The retention arms 18 illustrated individually in FIG. 8 of the backrest carrier 8 illustrated individually in FIG. 7 have at the free-end side, that is to say, at the seat or seat carrier side, a formed-on receiving member 38. The receiving member 38 is part of the rotary joint 20 which is constructed in this embodiment as a ball joint. The joint-socket-like or ball-socket-like receiving member 38 receives in the assembled state a spherical, substantially joint-head-like continuation 40 as a counter-piece. The continuation 40 is—as can be seen in particular in FIG. 6—fitted so as to protrude laterally to the seat carrier 6 or the synchronous mechanism 6*a* thereof.

The continuation 40 is formed by a spherical (joint) head 42 and a substantially pin-like (joint) neck 44 which is secured thereto.

The continuation 40 and the receiving member 38 form in the assembly state the rotary joint 20, wherein, as a result of the rotary joint 20, a securing of the respective retention arm 18 to the seat carrier 6 is additionally carried out. To this end, the retention arm 18 surrounds the seat carrier 6 in the assembly state at least partially at the longitudinal sides of the seat carrier 6 (FIG. 5) so that the spherical head 42 of the continuation 40 engages in the receiving member 38 in a positive-locking manner.

Figure 10:
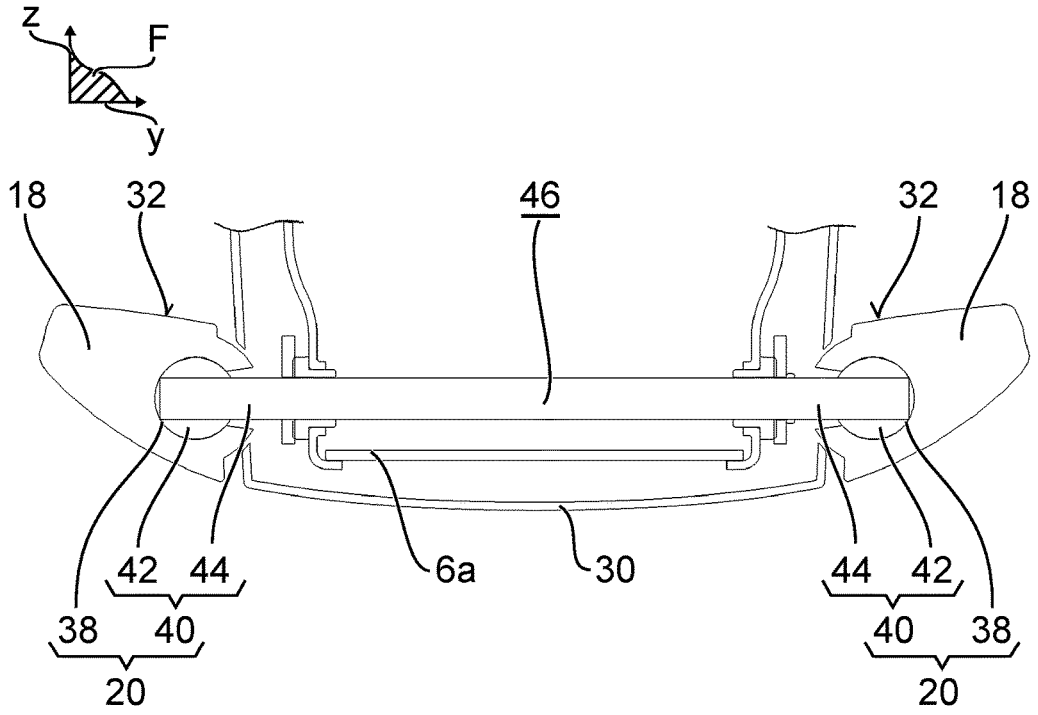
FIG. 10 is a sectioned illustration of ball joints between the seat carrier and the retention arms.
Figure 11:
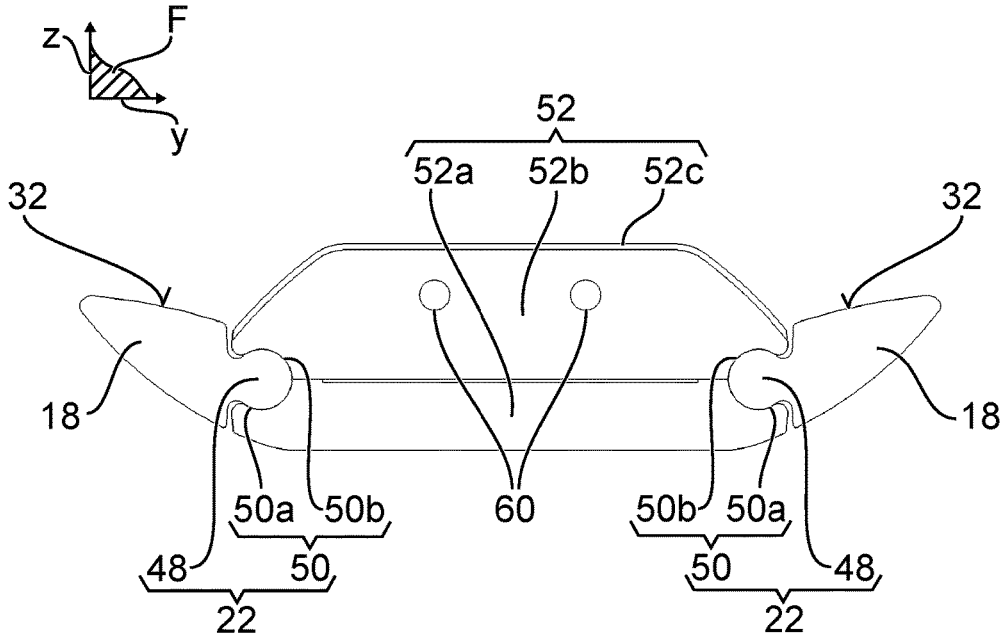
FIG. 11 is a sectioned illustration of hinge joints between the retention arms and the rocker arm.

FIG. 10 shows a cross-section of a front plane F which extends through the rotary joint 20. As can be seen comparatively clearly in the sectioned illustration of FIG. 10, the spherical head 42 of the continuation 40 is substantially completely in the receiving member 38 of the retention arm 18. In particular, the receiving member 38 surrounds the head 42 over the equator thereof so that the ball joint 20 is constructed in particular in the manner of a socket joint. The movability of the rotary joint 20 is thereby limited, which has an advantageous effect on the stability of the securing or the retention of the retention arm 18 on the seat carrier 6.

As illustrated in FIG. 10, the laterally diametrically opposed continuations 40 on the seat carrier 6 are connected to each other. In particular, the necks 44 of the heads 42 are constructed as a common pin or axial rod 46 which extends through the seat carrier 6 or the synchronous mechanism 6*a*. The stability of the continuations 40 is thereby improved.

Between the receiving member 38 and the free end 26*a*, a roller-like continuation or (joint) head 48 is formed on the retention arm 18. The head 48 is consequently arranged with spacing along the x axis or in the longitudinal direction of the arm with respect to the receiving member 38—and consequently with respect to the rotary joint 20.

In the assembly state (FIG. 11), the roller-like head 48 is surrounded by a channel-like (joint) receiving member 50 of a rocker arm 52 which is arranged between the retention arms 18. The longitudinal roller direction of the head 48 is in this instance orientated parallel along the longitudinal arm direction of the respective retention arm 18. The head 48 and the receiving member 50 form in this instance the rotary joint 22 which is in particular constructed as a hinge joint.

Consequently, both a ball joint 20 and a hinge joint 22 are arranged along each retention arm 18 so that in the longitudinal arm direction of the retention arms 18 a rotation axis D for the lateral tilting movability of the backrest 10 is formed. That is to say, the office chair 2 has in this embodiment two rotation axes D which extend below the seat member 12 and which are (horizontally) spaced apart from each other.

Figure 9:
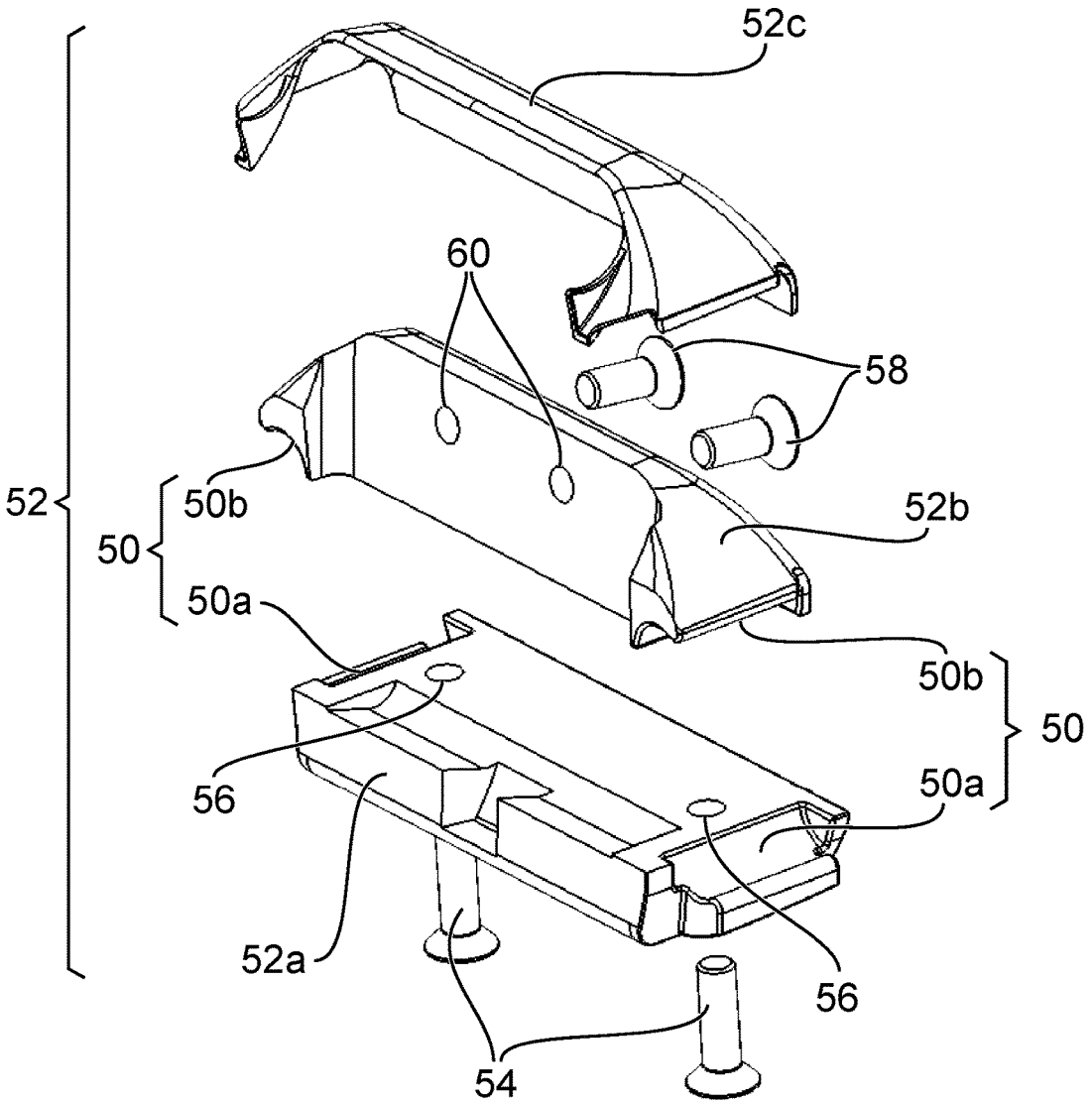
FIG. 9 is an exploded view of a rocker arm of the backrest carrier.

The rocker arm 52 which is illustrated individually in FIG. 9 comprises a lower half-shell or rocker arm portion 52*a* and an upper half-shell or rocker arm portion 52*b* which can be placed vertically thereon and a cover shell 52*c* which can be placed at least on the upper rocker arm portion 52*b* and which engages at least partially around it. In the assembly state, the rocker arm 52 is arranged in the manner of a transverse strut between the retention arms 18. The rocker arm 52 is in this instance secured in a flexible or articulated manner by means of the receiving members 50 in a positive-locking manner on the heads 48 of the retention arms 18.

In the assembly state, the rocker arm portions 52*a* and 52*b* are stacked vertically one above the other in a sandwich-like manner, that is to say, along the z axis. The rocker arm portions 52*a* and 52*b* have at the opposing narrow sides facing the retention arms 18 a substantially quarter-circle-like half-groove 50*a* or 50*b*, respectively. In the stacked or assembled state, the half-grooves 50*a* of the rocker arm portion 52*a* and the half-grooves 50*b* of the rocker arm portion 52*b* form the channel-like receiving member 50 for the hinge or rotary joint 22.

For assembly, the rocker arm portion 52*a* is guided from below on the retention arms 18 so that the heads 48 are each at least partially in the half-grooves 50*a*. Subsequently, the rocker arm portion 52*b* is positioned from above so that the upper half-grooves 50*b* are placed on the heads 48. As can be clearly seen from the sectioned illustration shown in FIG. 11 through the hinge joints 22, the receiving members 50 formed by the half-grooves 50*a* and 50*b* surround the respective heads 48 beyond the respective (roller) equator so that a secure and positive-locking (bearing-like) securing of the rocker arm 52 on the retention arms 18 is provided.

For assembly of the rocker arm 52, the rocker arm portions 52*a* and 52*b* are screwed vertically to each other. To this end, two securing screws 54 are guided from below through recesses 56 of the rocker arm portion 52*a* and screwed into corresponding threaded holes of the rocker arm portion 52*b*. Subsequently, the rocker arm 52 is secured by means of two securing screws 58 to the seat carrier 6. The securing screws 58 are to this end guided along the y axis through recesses 60 of the rocker arm portion 52*b* and screwed into corresponding threaded holes of the seat carrier 6 and/or the synchronous mechanism 6*a*. For optically attractive covering of the screw heads of the securing screws 58, the covering shell 52*c* is finally placed on the rocker arm portion 52*b*.

As a result of the positive-locking retention using the hinge joint 22, during the screwing fixing operation of the rocker arm 52 on the seat carrier 12 a securing of the bearing carrier 8 on the seat carrier 12 is consequently also carried out. That is to say, the bearing carrier 8 is, on the one hand, secured by means of the ball joints 20 and, on the other hand, by means of the rocker arm 52 to the seat member 12 of the office chair 2. A reliable and operationally secure securing or retention of the backrest 10 on the seat carrier 12 is thus produced. At the same time, the resilient deformability of the backrest carrier 8 is not influenced in a disadvantageous manner so that a lateral tilting movability is thereby not limited.

Preferably, an arresting or blocking means 62 is provided on the backrest carrier 8 and/or on the seat carrier 6, which in the event of an actuation by the user blocks, prevents or at least limits the lateral tilting movability of the backrest 10. An embodiment of the blocking means 62 is explained in greater detail below with reference to FIG. 12*a* and FIG. 12*b*.

Figure 12A:
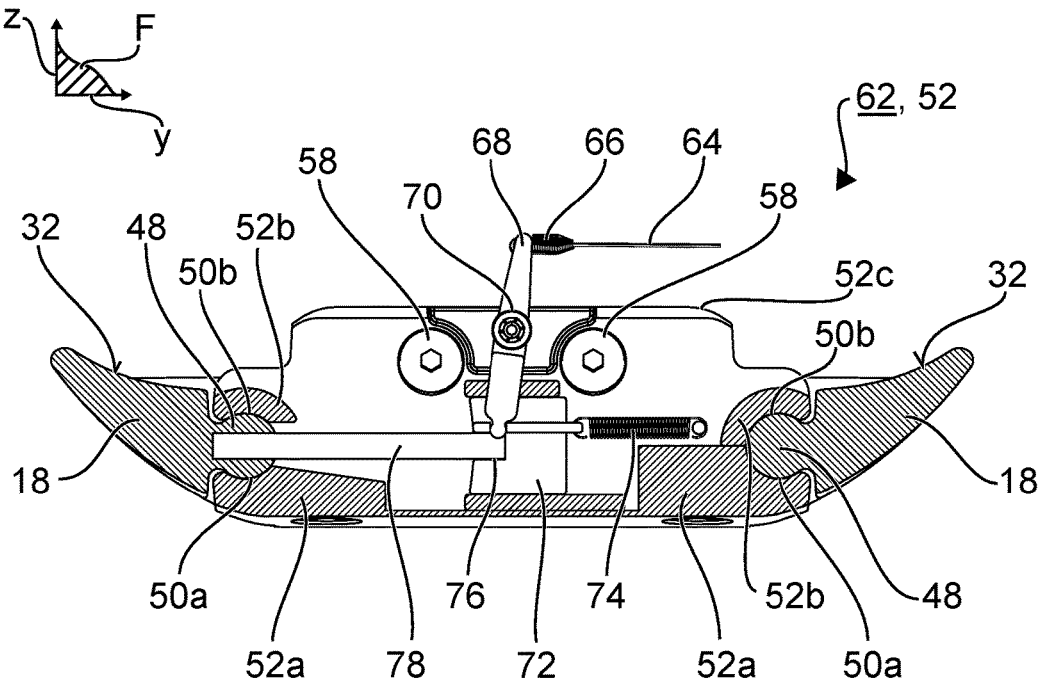
FIG. 12*a*, 12*b* is a sectioned illustration of a blocking means of the rocker arm.
Figure 12B:
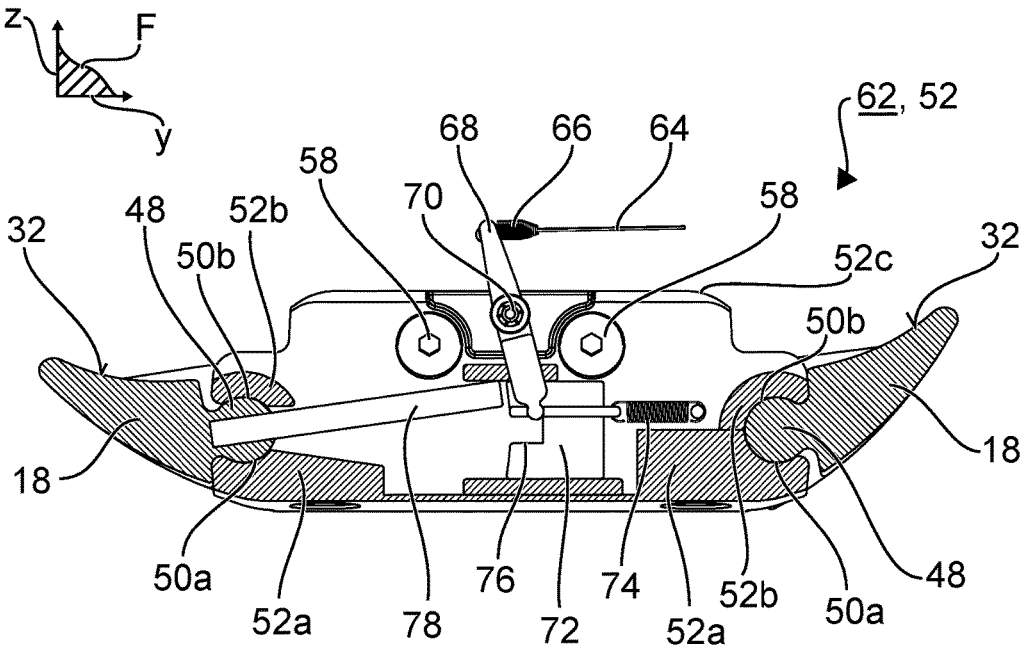

FIGS. 12*a* and 12*b* show as sectioned illustrations an alternative embodiment of the rocker arm 52 with a blocking means 62 which is integrated therein for blocking the movability of at least one of the hinge joints 22 of the retention arms 18 in a blocked state (FIG. 12*a*) and in an unblocked state (FIG. 12*b*). The rocker arm 52 is in this embodiment in particular constructed as a housing for the mechanism of the blocking means 62.

The blocking means 62 is consequently in particular configured and constructed to block or impede the second rotary joint 22, that is to say, the rotary joint which is arranged on the retention arm 18 closer to the backrest 10. Consequently, the movability along the rotation axis D or along the retention arm 18 between the seat-carrier-side rotary or ball joint 20 and the backrest carrier 8 is blocked. The lateral tilting movability of the backrest carrier 8 is thereby blocked or at least limited.

The blocking means 62 has for actuation a pulling cable 64 which is guided by means of a resilient element 66 on a lever element 68. This protrudes at least partially from the rocker arm 52 or from the covering shell 52*c*. The pulling cable 64 can be actuated by a user, for example, by means of a lever on the seat carrier 6. The lever element 68 which is pivotably supported at a central rotation location 70 is coupled at a free end opposite the resilient element 66 with a blocking block 72 which is guided in a linear manner along the y axis.

The blocking block 72 is coupled to a resilient element 74 which is constructed in particular as a tension spring and which is relaxed in the unblocked state. The blocking block 72 has a receiving member 76 for a blocking pin 78.

The blocking pin 78—as can be seen in FIGS. 12*a* and 12*b*—is coupled to the (joint) head 48 of the hinge joint 22 in a pivotably secure manner. This means that the blocking pin 78 is pivoted at the head side when the hinge joint 22 is rotated. The opposing blocking-block-side free end of the blocking pin 78 thereby pivots in the unblocked state along the z axis inside the rocker arm 52. The half-grooves 50*a* and 50*b* each have in this instance a recess which is not described in greater detail so that a through-opening is formed in the associated receiving member 50 for the blocking pin 78.

In the blocked state, the blocking-block-side free end of the blocking pin 78 engages in the manner of a locking detent and in a positive-locking manner in the receiving member 76 of the blocking block 72. In the blocked state, the tension spring 74 is tensioned. When the pulling cable 64 is actuated again, the blockage is released so that the tension spring 74 can relax and moves the blocking block 78 out of the blocking position. The free end of the blocking pin 78 thus slides out of the receiving member 76 so that the blocking pin 78 can be moved at the free end side.

With appropriate dimensions, the resilient element 66 has in this instance a greater resilient strength, that is to say, a greater resilient stiffness or spring constant, than the resilient element 74. A reliable and operationally safe actuation of the blocking means 62 is thereby achieved. In particular, the resilient element 74 is prevented from being relaxed in an undesirable manner and consequently the blocking is prevented from being released. In place of the resilient element 66, it is, for example, also possible for the pulling cable 64 to have an appropriately sized tensile resilience.

The invention is not limited to the embodiments described above. Instead, other variants of the invention can also be derived therefrom by the person skilled in the art without departing from the subject-matter of the invention. In particular all individual features which are described in connection with the embodiments can also be combined with each other in another manner without departing from the subject-matter of the invention.

It is, for example, conceivable that, in order to improve the restoring force with a deployed backrest carrier 8, the resilient deformability of the backrest carrier 8 is supported by means of additional resilient elements.

It is also, for example, conceivable for the blocking means 62 to be constructed and configured to block or arrest both rotary joints 22 on the retention arms 18. Preferably, the rotary joints 22 are in this instance blocked or impeded in a substantially synchronous manner in the event of an actuation.

LIST OF REFERENCE NUMERALS

2 Seating furniture/office chair
4 Supporting base/cruciform base
6 Seat carrier
6*a* Synchronous mechanism
8 Backrest carrier
10 Backrest
12 Seat member
14 Arm
16 Chair roller
18 Retention arm
20 Rotary joint/ball joint
22 Rotary joint/hinge joint
24 Armrest
26 U-shaped member/vertical member
26*a* Free end
28 U-shaped member/horizontal member
30 Housing
32 Abutment face
34 Transverse strut
36 Securing location
38 Receiving member

40 Continuation
42 Head
44 Neck
46 Pin/axial rod
48 Continuation/head
50 Receiving member
50*a*, 50*b* Half-groove
52 Rocker arm
52*a*, 52*b* Rocker arm portion
52*c* Covering shell
54 Securing screw
56 Recess
58 Securing screw
60 Recess
62 Blocking means
64 Pulling cable
66 Resilient element
68 Lever element
70 Rotary location
72 Blocking block
74 Resilient element/tension spring
76 Receiving member
67 Blocking pin
x, y, z Axis
S Sagittal plane
F Front plane
T Transverse plane
D Rotation axis

The invention claimed is:

1. An item of seating furniture, comprising:

a horizontal seat member;

a seat carrier for supporting said horizontal seat member;

a vertical backrest;

a backrest carrier for supporting said vertical backrest, said backrest carrier constructed in a substantially U-shaped manner with two vertically orientated members and a horizontal upper member, said vertically oriented members having seat-side free ends;

horizontally aligned retention arms extending from said seat-side free ends and extending below said horizontal seat member and at least partially laterally engaging around said seat carrier, said backrest carrier and said horizontally aligned retention arms produced as a unitary part from a deformable material which is elastic so as to be bendable; and rotary joints including a first rotary joint and a second rotary joint disposed along at least one rotation axis extending below said horizontal seat member, said rotary joints allowing a lateral tilting movability of said vertical backrest with respect to said seat carrier, said first and second rotary joints are disposed spaced apart from each other along the rotation axis.

2. The item of seating furniture according to claim 1, further comprising a rocker arm disposed between said vertically oriented members, said rocker arm being directed transversely relative to the rotation axis.

3. The item of seating furniture according to claim 2, wherein said rocker arm is formed from two half-shells which are stacked vertically one over the other.

4. The item of seating furniture according to claim 3, wherein said half-shells of said rocker arm are screwed to each other.

5. The item of seating furniture according to claim 4, further comprising a positioned covering shell, a screwing of said half-shells is concealed by means of said positioned covering shell.

6. The item of seating furniture according to claim 2, wherein said rocker arm is secured to said seat carrier.

7. The item of seating furniture according to claim 1 wherein:

said first rotary joint is a ball joint;

said horizontally aligned retention arms have a joint-socket-shaped receiving member; and said seat carrier having a joint-head-shaped continuation which engages in said joint-socket-shaped receiving member of said horizontally aligned retention arms.

8. The item of seating furniture according to claim 2 wherein:

said second rotary joint is a hinge joint;

said rocker arm has a groove-shaped receiving member; and said horizontally aligned retention arms each have a roller-shaped continuation which is surrounded in each case by said groove-shaped receiving member of said rocker arm.

9. The item of seating furniture according to claim 2, further comprising an actuatable blocker for impeding or blocking the lateral tilting movability of said backrest carrier.

10. The item of seating furniture according to claim 9, wherein said actuatable blocker is constructed to block a movability of said second rotary joint.

11. The item of seating furniture according to claim 9, further comprising a resiliently loaded blocking block; and wherein said actuatable blocker is disposed in said rocker arm and has a blocking pin which is coupled to said second rotary joint in a pivotably secure manner and which can be moved into in a forming-locking engagement with said resiliently loaded blocking block.

12. The item of seating furniture according to claim 1, wherein the item of seating furniture is an office chair.

13. The item of seating furniture according to claim 1, further comprising a rocker arm disposed between said horizontally aligned retention arms, said rocker arm being directed transversely relative to the rotation axis.

* * * * *